US009899773B2

(12) United States Patent
Elia

(10) Patent No.: US 9,899,773 B2
(45) Date of Patent: Feb. 20, 2018

(54) COUPLING DEVICE FOR QUICK MOUNTING AND DEMOUNTING AN INTEGRATED LIGHT SOURCE

(71) Applicant: OPTARGET Sp. z 0.0., Zielona Góra (PL)

(72) Inventor: Federico Elia, Catanzaro (IT)

(73) Assignee: OPTARGET SP. Z.O.O., Zielona Gora (PL)

( * ) Notice: Subject to any disclaimer, the term of this patent is extended or adjusted under 35 U.S.C. 154(b) by 477 days.

(21) Appl. No.: 14/414,270

(22) PCT Filed: Jul. 12, 2013

(86) PCT No.: PCT/EP2013/064821
§ 371 (c)(1),
(2) Date: Jan. 12, 2015

(87) PCT Pub. No.: WO2014/009544
PCT Pub. Date: Jan. 16, 2014

(65) Prior Publication Data

US 2015/0200490 A1 Jul. 16, 2015

(30) Foreign Application Priority Data

Jul. 12, 2012 (PL) ..... 399919

(51) Int. Cl.
*H01R 13/639* (2006.01)
*F21V 21/22* (2006.01)
(Continued)

(52) U.S. Cl.
CPC ..... *H01R 13/639* (2013.01); *F21S 8/08* (2013.01); *F21S 8/085* (2013.01);
(Continued)

(58) Field of Classification Search
CPC ..... H01R 13/639; F21S 6/005; F21S 8/081; F21V 19/0025; F21V 21/20; F21V 21/22; B29L 2031/766
See application file for complete search history.

(56) References Cited

U.S. PATENT DOCUMENTS 1,930,926 A * 10/1933 Doane ..... F21S 6/001 174/69
3,805,055 A 4/1974 Cassey
(Continued)

FOREIGN PATENT DOCUMENTS

CN 2148880 Y 12/1993
CN 2221709 Y 3/1996
(Continued)

*Primary Examiner* — Jong-Suk (James) Lee
*Assistant Examiner* — Colin Cattanach
(74) *Attorney, Agent, or Firm* — Browdy and Neimark, PLLC

(57) ABSTRACT

A coupling device for quick mounting and demounting an integrated light source, comprising two tubular intermediate elements (A, B) having mutually matching cross-sections, each element (A, B) having a first ending and a second ending and being telescopically connectable with each other by inserting their first endings one into the other, each intermediate element (A, B) consisting of at least two tubular members (A-a, A-b; B-a, B-b) having different cross-sections of close dimensions, the members (A-a; B-a) of the intermediate elements (A, B) having bigger cross-sections and the members (A-b; B-b) of the intermediate elements (A, B) having smaller cross-sections, and the element (A) being telescopically connectable by its smaller member (A-b) with a socket (C) comprising electrical connections while the element (B) is telescopically connectable by its bigger member (B-a) with the light source (D). At least one line enabling electrical current transmission is run inside both intermediate elements (A, B) in a tight manner, and in that all the connections, both of the intermediate elements
(Continued)

Figure 1A:
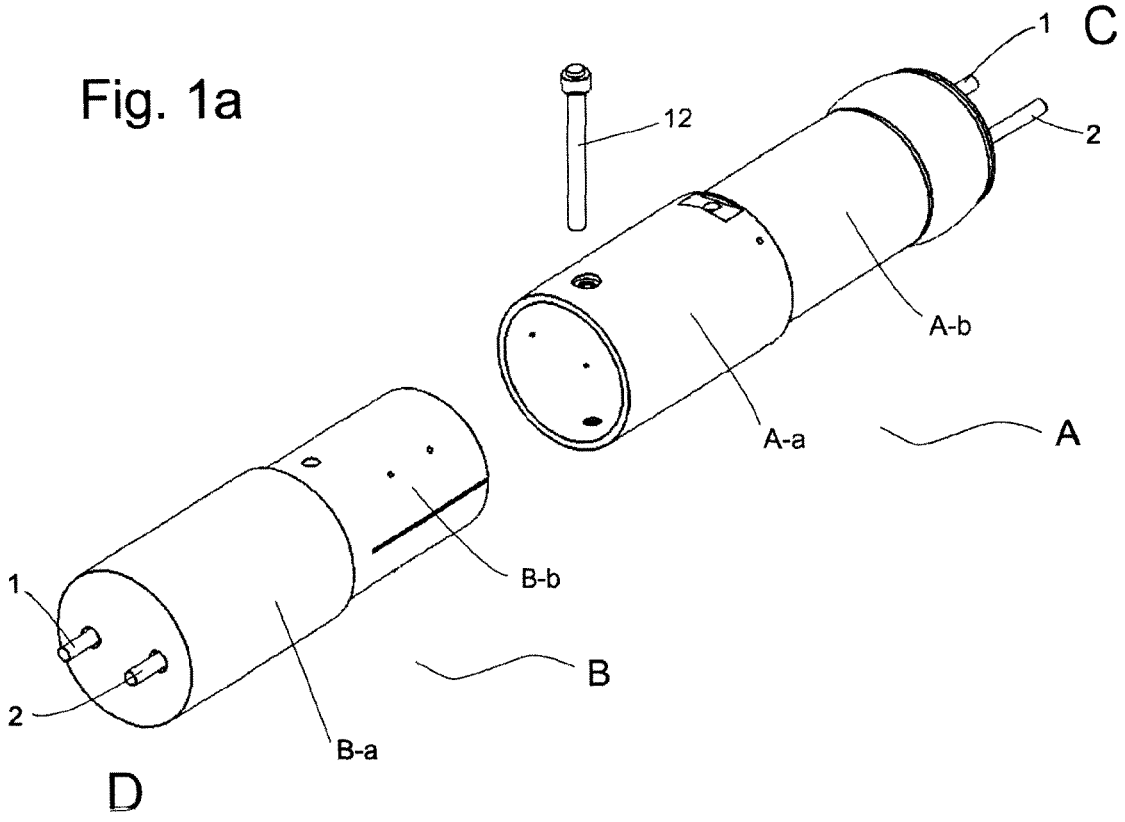

(A, B) with each other and of the intermediate elements (A, B) with respectively the socket (C) and the light source (D), ensure electrical current transmission from the socket (C) to the light source (D).

20 Claims, 5 Drawing Sheets

(51) Int. Cl.

| | |
|---|---|
| ***H01R 27/02*** | (2006.01) |
| ***H01R 24/68*** | (2011.01) |
| ***H01R 24/76*** | (2011.01) |
| ***F21V 19/00*** | (2006.01) |
| ***F21S 8/08*** | (2006.01) |
| ***F21V 21/00*** | (2006.01) |
| ***F21V 23/06*** | (2006.01) |
| *F21W 131/103* | (2006.01) |
| *F21Y 115/10* | (2016.01) |

(52) U.S. Cl.
CPC ..... *F21V 19/0025* (2013.01); *F21V 21/00* (2013.01); *F21V 21/22* (2013.01); *F21V 23/06* (2013.01); *H01R 24/68* (2013.01); *H01R 24/76* (2013.01); *H01R 27/02* (2013.01); *F21W 2131/103* (2013.01); *F21Y 2115/10* (2016.08)

(56) References Cited

U.S. PATENT DOCUMENTS

| | | | | |
|---|---|---|---|---|
| 6,082,877 | A * | 7/2000 | Hughes | F21S 6/005 362/152 |
| 6,357,896 | B1 * | 3/2002 | Yeh | E04H 12/18 362/410 |
| 6,642,659 | B1 | 11/2003 | Hsieh | |
| 6,692,142 | B1 * | 2/2004 | Gordin | B60P 3/18 362/413 |
| 8,215,863 | B2 * | 7/2012 | Sohn | A45B 9/00 135/75 |
| 2002/0197106 | A1 * | 12/2002 | Wu | F16B 7/042 403/329 |
| 2003/0095411 | A1 | 5/2003 | Blackwelder | |
| 2005/0185398 | A1 * | 8/2005 | Scannell, Jr. | A01G 9/02 362/227 |
| 2006/0044789 | A1 * | 3/2006 | Curtis | F21S 8/088 362/152 |
| 2006/0146527 | A1 | 7/2006 | VanderSchuit | |
| 2006/0204322 | A1 * | 9/2006 | Roiser | A45B 9/00 403/109.5 |
| 2010/0029268 | A1 * | 2/2010 | Myer | F21S 2/00 455/426.1 |
| 2010/0040406 | A1 * | 2/2010 | Lenhart | A63C 11/221 403/109.5 |
| 2012/0143383 | A1 * | 6/2012 | Cooperrider | H04Q 9/00 700/295 |
| 2014/0182232 | A1 * | 7/2014 | Holt | B29C 70/56 52/645 |

FOREIGN PATENT DOCUMENTS

| | | | | |
|---|---|---|---|---|
| CN | 2299985 | Y | 12/1998 | |
| CN | 201096296 | Y | 8/2008 | |
| EP | 1887280 | A1 * | 2/2008 | F16B 7/1427 |
| GB | 2339012 | A | 1/2000 | |

* cited by examiner

FIG. 2
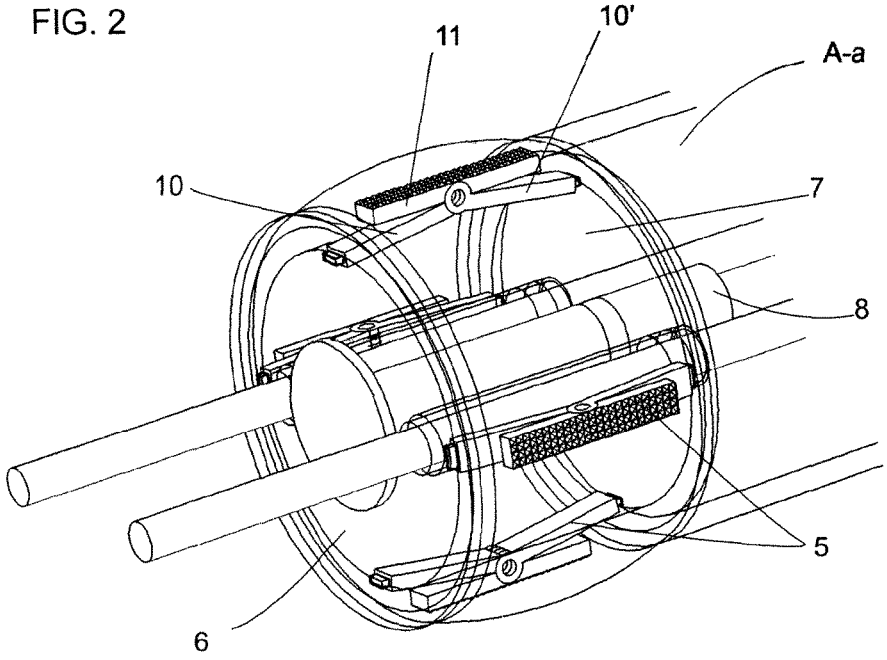
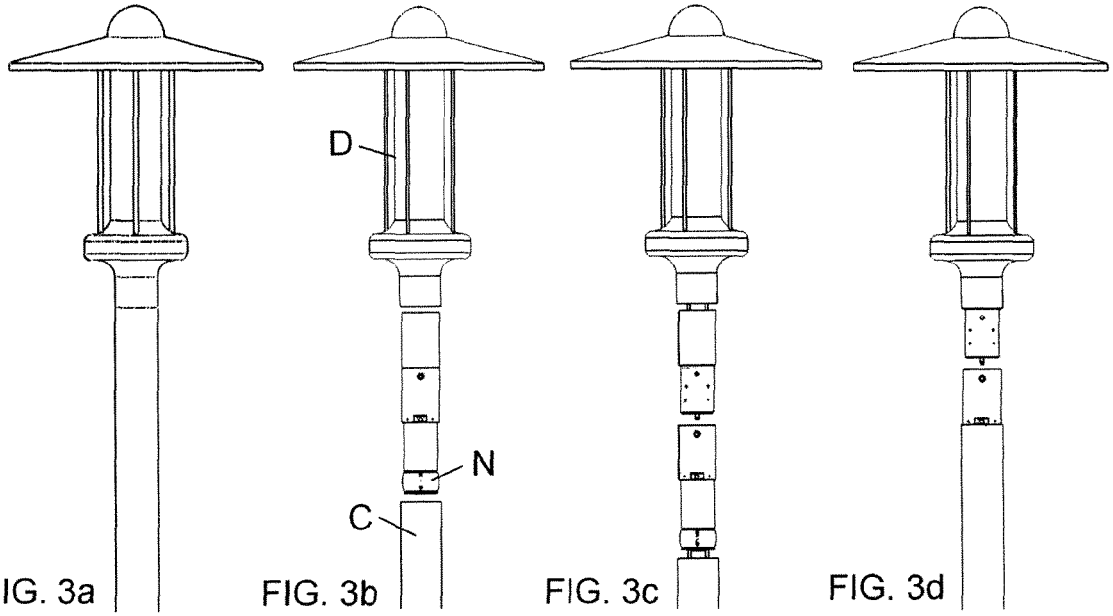
FIG. 3a FIG. 3b FIG. 3c FIG. 3d

Fig. 6a
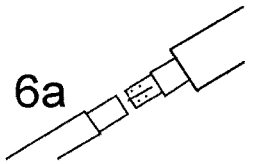
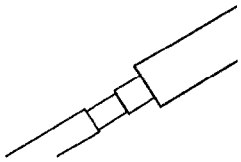
Fig. 6b
Fig. 6c
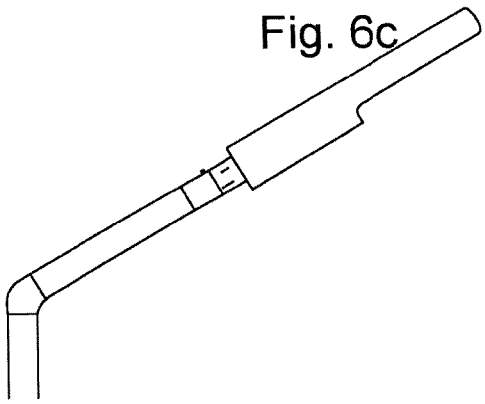

COUPLING DEVICE FOR QUICK MOUNTING AND DEMOUNTING AN INTEGRATED LIGHT SOURCE

The invention relates to a coupling device for quick mounting and demounting an integrated light source. The integrated light source is in particular a LED street lamp mounted on a street or garden post.

External lanterns with integrated LED lamps constituting the light source(named LED street light) weighting about 18-20 kg are widely known and used. Due to their substantial weight, the installation, maintenance and replacement of such lamps is difficult and it may be more dangerous than in the case of traditional street lamps, considering in particular the typical installation height, e.g. 4-12 m of the street light.

A traditional street light including a light bulb weights about 3-4 kg, the replacement of the bulb being easy because of its small weight—about 200 g and the simplicity of the mounting system. As opposed to the traditional lanterns in which the only element to be replaced is the light bulb, the servicing and replacement of the LED street light having the integrated LED light source, may involve the replacement of the Power Supply, of a LED module, of a LED diode, of a IC controller or of the whole lamp (if repair proves impossible).

In order to replace any of the above listed elements, the following steps need to be taken:

- mounting to the required elevation (between 4 and 12 m) by means of an aerial platform;
- opening the lamp (by means of a tool or manually, by disengaging the latches);
- remaining at the elevated position during the servicing, all the hazards considered (dropping the tools and equipment, unfavorable weather conditions, etc.).

If the Power Supply is in need to be serviced or replaced, two types of couplings may be used: a quick connection or a standard connection. In the case of the quick connection (used only by selected firms), in order to disconnect the coupling a screw or a pin is removed, a screw-protected casing is unscrewed and/or Power Supply is removed from its location and subsequently replaced by a new one by performing the same procedures again—time consumption about 15 min.

In the case of the standard connection, the coupling needs to be unscrewed both on the electrical line side and on the side of the lamp, and the Power Supply needs to be unscrewed in order to have a new one subsequently installed—time consumption about 25 min.

In the case where the LED module needs to be replaced, there are numerous options possible. The easier one is when the modules are provided with quick couplings (used only by selected firms); in this case the repair time consumption is about 10-25 min.

If the modules are not provided with the quick couplings the repair is more complicated because a glass cover needs to be taken off, a PCB plate needs to be removed from the lamp housing or the radiator, two connections with the integrated circuits need to be unsoldered. Then a new PCB plate is soldered again and finally the glass cover is replaced; minimal time consumption about 25 min.

In the case where the LED diode or the IC controller needs to be replaced, the procedure is similar to that in the case of the LED module replacement. Depending on the technique used by the LED manufacturer, the time consumption of one or more LEDs replacement with one or more controllers may vary as a function of the number of LEDs and IC controllers to be replaced. In any case, the repair always involves soldering at high elevation and the time consumption of the repair of just one element is at least 25 min.

In the case where the lamp may not be repaired and needs to be replaced as a whole, the procedure also includes dismantling of the lamp (usually 4 screws), disconnecting supply cables both on the light source side and on the lamp side, mounting a new lamp on the lamp post and making new connections. The time consumption of the replacement is about 20-25 min, all the steps being performed at the elevation of 4-12 m.

All the traditional methods of installation and dismounting of the lamps used in the street light and the external lighting systems included the integrated LED Street light have the disadvantage consisting in high workload and time consumption.

The aim of the invention was to speed-up the process of installation of the lanterns comprising the LED Street light or other new generation lamps, the inventive solution being also applicable to the traditional street lanterns. Another indirect advantage of the invention is a shortened time consumption of the post-sale servicing and the improved safety of the same as well as the lowered cost of the installation and maintenance resulting in improved effectiveness of the street lighting (the damaged lamps may be repaired/replaced quickly). Also the system is not invasive because the main pole will look like as without any other device.

According to the invention a coupling device is provided for quick mounting and demounting an integrated light source, comprising two tubular intermediate elements having mutually matching cross-sections, each intermediate element having a first ending and a second ending and being telescopically connectable with each other by inserting their first endings one into the other, each intermediate element consisting of at least two tubular members having different cross-sections of close dimensions, the first members of the intermediate elements having bigger cross-sections and the second members of the intermediate elements having smaller cross-sections, one intermediate element being telescopically connectable by its second smaller member with a socket comprising an electrical connection while the other intermediate element is telescopically connectable by its first bigger member with the light source.

The coupling according to the invention is characterized in that at least one line enabling electrical current transmission is run inside both intermediate elements in a tight manner, and in that all the connections, both of the intermediate elements with each other and of the intermediate elements with respectively the socket and the light source ensure electrical current transmission from the socket to the light source.

Preferably, a line enabling data transmission is run inside both intermediate elements ensuring transmission of a data signal from the socket to the light source.

All the tubular members of the intermediate elements may have a cross-section selected from a group comprising: a circular cross-section, an oval cross-section, a polygonal cross-section and a rounded cross-section.

Preferably, the second ending of the intermediate element connected with the socket comprising electrical or electrical and data connections, the said second ending belonging to the second smaller member of the said intermediate elements, has its external periphery adapted to the internal shape of the socket.

The external dimension of the cross-section of the said second ending may be adjustable depending on the internal dimension of the socket.

The said second ending is preferably extended by an expanding system having an adjustable internal dimension.

Preferably, the expanding system is surrounded by an additional annular sleeve made of an elastic material.

The expanding system may preferably comprise two plates, each plate extending transversely to the tubular member, the expanding system being connected with the respective member of the intermediate element by a socket head screw enabling adjustment of the connection length, while at least two expander grips are radially arranged between the two plates, each expander grip comprising a blocking element and two arms pivotally connected with each other by their one ends and abutting one of the plates with their other ends, the pivot connecting the arms being arranged on the blocking element of the expanding system.

Each blocking element of the expanding system preferably consists of a plate that is parallel to the axis of its adjoining intermediate element and abuts the internal surface of the socket, while each blocking element is provided on its surface abutting the internal surface of the socket with an antislip layer.

The annular sleeve is preferably located between the internal surface of the socket and the blocking elements, each blocking element abutting the internal surface of the sleeve.

Preferably, the integrated light source is a LED street lamp and the socket comprising electrical or electrical and data connections is located in the street lamp post.

The internal shape of the cross-section of the second end of the intermediate element may be adapted to the external shape of the cross-section of a typical integrated LED street lamp.

Preferably, at least one telescopic connection is provided with a blocking mechanism, preferably a pin or a peg.

The telescopic connections of the intermediate elements and all the blocking mechanisms may be provided with moisture and water tight gaskets.

Preferably, all the tubular members of the intermediate elements have circular cross-sections and the diameter of the first bigger member of the tubular element to be connected with the socket has the internal diameter between 30 mm do 200 mm.

The coupling device according to the invention enables to solve many problems related to the public street lighting. This inventive idea has been inspired by the attempts to improve the effectiveness of public lighting while keeping the costs minimal and bearing in mind the comfort of the public and of the service staff.

The terms, "telescopic connection" and "telescopically connectable" used in this text should be understood as referring to two tubular elements the endings of which are inserted one into another. Generally speaking, the connection is of the type of a socket and plug connection, in particular an aluminum socket and plug connection.

Figure 1B:
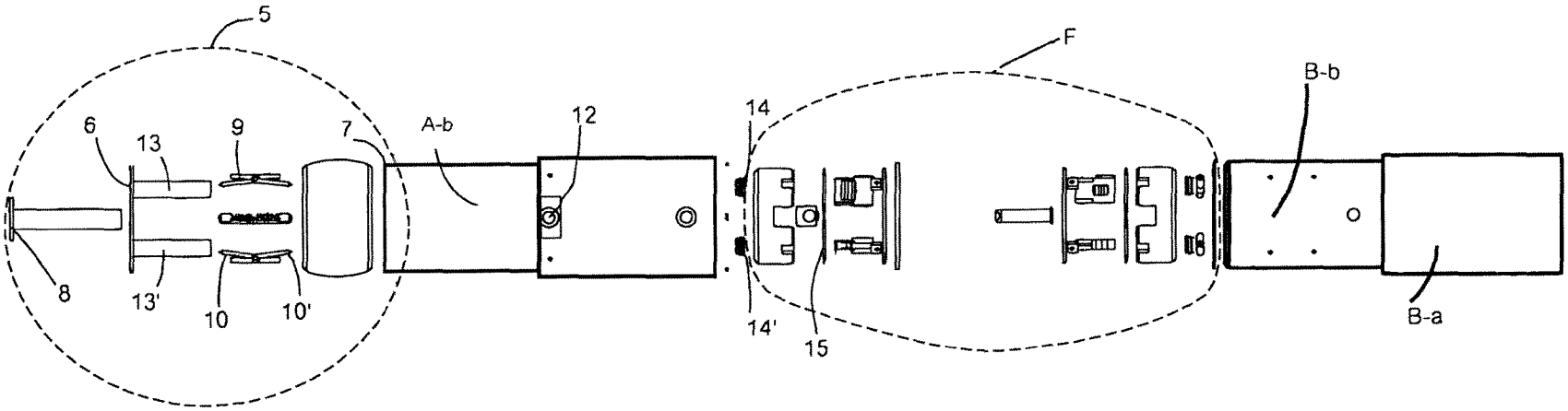
Figure 4A:
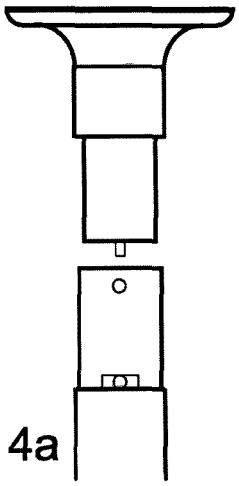
Figure 4B:
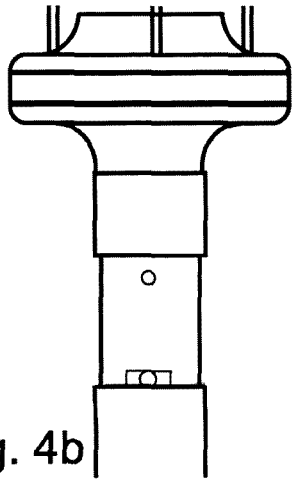
Figure 4C:
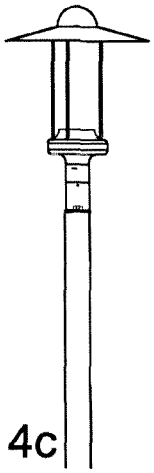

Preferred embodiments of the invention will be described below with reference to the appended drawings in which:

FIG. 1*a* shows a perspective exploded view of the coupling device according to the invention;

FIG. 1*b* shows a side exploded view of the coupling device according to the invention;

FIG. 2 shows a perspective view of the expanding system;

FIGS. 3*a*-3*d* show a fragment of a park lamp post with a lamp installed without the coupling device according to the invention (3*a*), and in various stages of installation of the lamp using the coupling device according to the invention (3*b*-3*d*);

FIG. 4*a* shows an enlarged fragment of a park lamp post during installation of a lamp using the coupling device according to the invention;

FIGS. 4*b*-4*c* show a fragment of a park lamp post upon installation of a lamp using the coupling device according to the invention;

FIGS. 5*a*-5*d* show a fragment of a street lamp post with a lamp installed without the coupling device according to the invention (5*a*), and in various stages of installation of the lamp using the coupling device according to the invention (5*b*-5*d*);

FIG. 6*a* shows a fragment of a street lamp post during installation of a lamp using the coupling device according to the invention;

FIGS. 6*b*-6*c* show a fragment of a street lamp post upon installation of a lamp using the coupling device according to the invention.

As shown in FIG. 1, the coupling device according to the invention consists of two intermediate elements A and B, which are telescopically connectable with each other i.e. by inserting one into the other. FIGS. 1*a* and 1*b* show that the two intermediate elements A and B to be placed between a pole and an integrated light source, e.g. a street lamp, below referred to as "the lamp") have their electrical lines and connections inside, in order to enable transmission of the electrical current powering to the lamp and optionally of the data necessary to remote control of the lamp (for new technologies incoming). Hence, in order to adjust the lighting intensity, check the power consumption, control the operation or realize any other functions of the lamp, it may be operated by means of a computer, a dedicated processor or a controller.

Both intermediate elements A and B are provided with an internal or external mounting system having adjustable diameter and may be installed on various types of tubes or poles.

In the case where the coupling device according to the invention is used on an existing lamp post, the intermediate element A may be mounted on the post by connecting it with a socket C comprising electrical connections. Due to the expanding system 5 that may be adapted to various post diameters, the coupling device according to the invention may be mounted on almost any typical lighting posts. The second intermediate element B may be connected to a lamp (of any type) having an integrated light source, typically a LED lamp because, similarly to the lighting posts, the mounting diameters of the lamps fit widely used standards.

In other cases, both the lamps and the posts may be factory equipped with coupling devices according to the invention in order to make their installation and demounting easier, which in consequence will make the installation and servicing shorter and simple.

As shown in FIG. 1*a*, each intermediate element A, B consists of two tubular members A-a, A-b and respectively B-a, B-b made of any suitable material. The two member s of each intermediate element have different but close dimensions, in particular the diameters of their cross-sections. Both intermediate elements A and B are connected with each other by insertion of their first endings a and b one into the other. The intermediate element A is telescopically connected, by its second, narrower end b, with the socket C comprising electrical and optionally data transmission connections, while the intermediate element B is telescopically connected, by its second, wider end a with the light source D. At least one line 1 enabling electrical current transmission is run in a water and moisture tight manner inside both intermediate elements A and B. Optionally another line 2 may be run inside both intermediate elements A and B ensuring transmission of a data signal, all the connections, both of the intermediate elements A, B with each other and of the intermediate elements A, B with respectively the socket C and the light source D, ensure electrical current or current and data transmission from the socket C to the light source D.

The tubular members A-a, A-b and respectively B-a, B-b of the intermediate elements A and B may have diameters in the range of 30 to 200 mm inside and from 36 to 206 mm outside. The length of the members may also vary, preferably between 35 to 1200 mm.

In FIG. 1*b* a side exploded view of the device according to the invention is presented. As shown, the intermediate element A is composed of the members A-a and A-b, and it is provided with the expanding system 5 delimited by two plates 6 and 7 and comprising expander grips 9, e.g. two or four expander grips 9. Each expander grip 9 has two arms 10, 10' pivotally connected with each other by their first ends. The expanding system 5 is surrounded by an elastic sleeve N. Inside the intermediate elements A and B, the electrical connections E are located in a tight manner. Into the tubular member A-a of the intermediate element A, the tubular member B-b of the intermediate element B is inserted. Upon connection of the member B-a of the intermediate element B with the lamp, a complete coupling is being formed.

FIGS. 3*a*-3*d* show a fragment of a park lamp post with a lamp installed without the coupling device according to the invention (3*a*) i.e. before it has been installed via the coupling device according to the invention, and in various stages of installation of the lamp using the coupling device according to the invention (3*b*-3*d*).

In FIG. 4*a* the step of installation of the lamp of FIG. 3*d* in shown in an enlarged view.

FIG. 4*b* shows an enlarged fragment of a park lamp post upon installation of a lamp using the coupling device according to the invention and FIG. 4*c* shows a fragment of a park lamp post as in FIG. 3*a* but with a lamp mounted via the coupling device according to the invention.

Similarly, FIGS. 5*a*-5*d* show a fragment of a street lamp post with a lamp installed without the coupling device according to the invention (5*a*), i.e. before it has been installed via the coupling device according to the invention, and in various stages of installation of the lamp using the coupling device according to the invention.

Figure 5A:
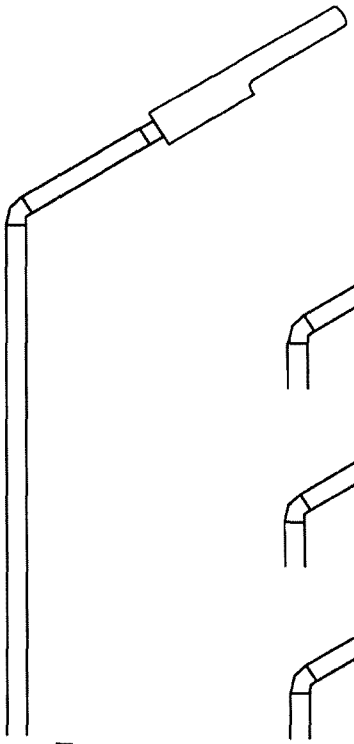
Figure 5B:
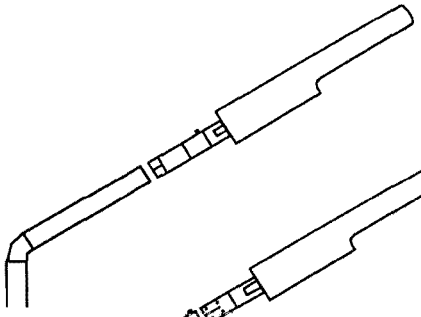
Figure 5C:
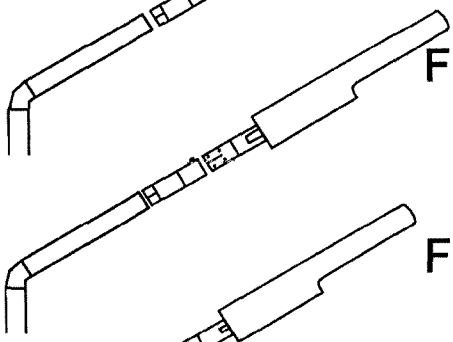
Figure 5D:
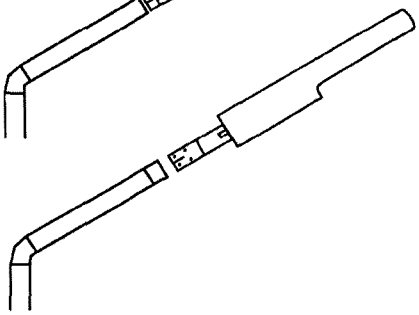

In FIG. 6*a* the step of installation of a street lamp of FIG. 5*d* is shown in an enlarged view. FIG. 6*b* shows an enlarged fragment of this lamp post upon installation of a lamp using the coupling device according to the invention and FIG. 6*c* shows a fragment of the lamp post of FIG. 5*a* but upon installation of a lamp using the coupling device according to the invention.

FIG. 2 shows an enlarged perspective view an exemplary embodiment of the expanding system 5 that is connected to the ending portion of the tubular member A-a. The expanding system 5 includes two plates 6 and 7 that are transversal to the tubular member A-a, their shape being adapted to the shape of the tubular member cross-section, e. g. circular. A socket head screw 8, e.g. a hexagonal head socket screw extends through the plates 6 and 7 and connects the expanding system 5 with the tubular member A-a in a way enabling adjustment of the connection length. Between the plates 6 and 7 at least two, and preferably four, expander grips 9 are radially arranged, each comprising a blocking element 11 having a knurled external surface and two arms 10, 10' pivotally connected with each other by their first ends and abutting one of the plates 6, 7 with their second ends, the pivot X connecting the arms 10, 10' being arranged on the blocking element 11 of the expanding system 5.

Before the connection of the two elements is formed, the screw 8 must turned around by means of a tool that is inserted into the intermediate element A through an open ending of the member A-a. By turning the screw 8 it is possible to adjust the length of the intermediate element A and the diameter of the tubular member A-a ending. The said diameter depends on the distance between the plates 6 and 7 and on the mutual angle of orientation of the arms 10 and 10'.

The a blocking elements 11 of the expanding system 5 may have a form of plates parallel to the axis of the intermediate element A and abutting the internal side of the socket C and each blocking element 11 may be provided with an antislip layer, e.g. may have a knurled external surface.

Optionally, an annular sleeve N made of an elastic material may be located between the internal surface of the socket C and the blocking elements 11 so that each blocking element 11 rests on the internal surface of the sleeve N. the elastic material may be rubber or any other suitable material.

In a preferred embodiment, the circular plates 6 and 7 of the expanding system 5 have a diameter of about 30 mm to 200 mm. The electrical connections E are located in a water and moisture tight manner inside both intermediate elements. The device may be further equipped with a blocking mechanism connecting the intermediate elements A and B with each other.

The blocking mechanism may have a form of a pin or a peg 12 inserted transversally through a dedicated opening.

The exemplary intermediate element A, the member A-b of which is extended by the expanding system 5, comprises: two circular plates 6, 7 of 30 to 200 mm diameter, located in a tubular casing, one socket head screw 8 having its thread length from 35 to 1200 mm, four expander grips 9 having the length from 35 to 1200 mm, and a gasket. Two openings designed to position the second plate 6 are formed in the tubular casing of the intermediate element A, as well as one opening dedicated for insertion of the screw. There are also additional openings in the casing designed for alignment of the telescopic connection. Two tubes 13, 13' extend from the plate 6 towards the inside of the expanding system 5 enabling precise coupling of the plate 6 with the intermediate element A and provide a passage for the electrical lines 1, 2 form the outside to the inside of the element A. One additional opening is centrally located on the plate 7 in order to allow insertion of the socket head screw 8. All the openings are protected by gaskets 14, 14' surrounding the cables and preventing penetration of water and/or impurities. The connection of the intermediate elements A and B is protected by a gasket 15.

The coupling device according to the invention provides the advantage of reduction of the costs and time consumption of the integrated light source lamp installation and repair. It results in a lowered risk of performing these operations by the specialized staff working at elevated altitudes during half the time required in case of the traditional lamp installation/repair techniques.

The intermediate element B is a part of the device that is mounted on a street lamp with an integrated light source. The electrical connections enclosed inside the coupling device enable transmission of electrical current and optionally data signal as well as the control of the lamp operation (also by means of a computer or a dedicated controller etc.). Upon engagement of the two intermediate elements A and B, the mutually compliant electrical connections meet with each other and all the connections are tightly closed. of The two intermediate elements A and B are finally fastened with each other by pressure screws constituting the first lock. Besides, a fast blocking axis system may be provided or a pin lock mechanism. Any known and suitable systems of locking a tubular telescopic connection are foreseeable.

The invention claimed is:

1. A coupling device for mounting and demounting an integrated light source connectable to a socket, the coupling device comprising:

a socket connectable intermediate element and a light source connectable intermediate element having mutually matching cross-sections, wherein each of the socket connectable intermediate element and the light source connectable intermediate element having a first ending and a second ending and being telescopically connectable with each other by inserting their first endings one into the other, wherein their second endings are configured to connect to the light source and to the socket respectively, wherein the connection of the socket connectable intermediate element and a light source connectable intermediate element with each other and the connection of the socket connectable intermediate element and the light source connectable intermediate element with respectively the socket and the light source, are configured to ensure electrical current transmission from the socket to the light source, wherein the socket connectable intermediate element and the light source connectable intermediate element each consist of at least two tube-shaped members having different cross-sections, wherein the socket connectable intermediate element consists of a first socket connectable member and a second socket connectable member, the first socket connectable member having a cross-section larger than a cross-section of the second socket connectable member, wherein the second ending of the socket connectable intermediate element is disposed on the second socket connectable member, wherein the light source connectable intermediate element consists of a first light source connectable member and a second light source connectable member, the first light source connectable members having a cross section larger than a cross-section of the second light source connectable member, wherein the socket connectable intermediate element is configured to telescopically connect by the second socket connectable member with the socket comprising an electrical connection, wherein the light source connectable intermediate element is configured to telescopically connect by the first light source connectable member with the light source, wherein the coupling device further comprises:

at least one line enabling electrical current transmission which is run inside both the socket connectable intermediate element and the light source connectable intermediate element, and an expanding system connected to and configured to extend the second ending of the second light source connectable member, the expanding system comprising:

two plates, each plate extending transversely to the first light source connectable member, a socket head screw to connect the expanding system with the second light source connectable member, and at least two expander grips radially arranged between the two plates, each expander grip comprising a blocking element and two arms pivotally connected to one another by a pivot at one end and abutting one of the plates with a second end, the pivot connecting the arms being arranged on the blocking element of the expanding system.

2. The coupling device according to claim 1, further comprising a line enabling data transmission run inside the socket connectable and the light source connectable intermediate elements ensuring transmission of a data signal from the socket to the light source.

3. The coupling device according to claim 1, wherein the socket connectable and the light source connectable intermediate elements have a cross-sectional shape selected from a group comprising: a circular cross-section, an oval cross-section, a polygonal cross-section and a rounded cross-section.

4. The coupling device according to claim 1, wherein the second ending of the socket connectable intermediate element connected with the socket comprises electrical or electrical and data connections, and has an external periphery configured to engage with an internal shape of the socket.

5. The coupling device according to claim 1, wherein an external dimension of the cross-section of said second ending of the second socket connectable member is configured to be adjusted depending on an internal dimension of the socket.

6. The coupling device according to claim 1, wherein said second ending of the second socket connectable member is extended by the expanding system having an adjustable internal dimension.

7. The coupling device according to claim 1, wherein the expanding system is surrounded by an additional annular sleeve made of an elastic material.

8. The coupling device according to claim 1, wherein each blocking element of the expanding system (5) consists of a plate that is parallel to a longitudinal axis of the socket connectable intermediate element and abuts an internal surface of the socket, and each blocking element has a surface abutting the internal surface of the socket comprising an antislip layer.

9. The coupling device according to claim 7, wherein the additional annular sleeve is located between an internal surface of the socket and the blocking elements, each blocking element abutting the internal surface of the sleeve.

10. The coupling device according to claim 1, wherein the integrated light source is a LED street lamp and the socket comprising electrical or electrical and data connections is located in the street lamp post.

11. The coupling device according to claim 10, wherein an internal shape of the cross-section of the second end of the light source connectable intermediate element is configured to engage an external shape of a cross-section of the integrated LED street lamp.

12. The coupling device according to claim 1, wherein at least one telescopic connection of the socket connectable intermediate element and the light source connectable intermediate element is provided with a blocking mechanism.

13. The coupling device according to claim 1, wherein telescopic connections of the socket connectable intermediate element and the light source connectable intermediate element are provided with moisture and water tight gaskets.

14. The coupling device according to claim 1, wherein all of the tube-shaped members of the socket connectable intermediate element and the light source connectable intermediate element each have circular cross-sections and the diameter of the first socket connectable member is configured to be connected with the socket having the internal diameter between 30 mm and 200 mm.

15. The coupling device according to claim 12, wherein the blocking mechanism is a pin or a peg.

16. The coupling device according to claim 2, wherein the second ending of the socket connectable intermediate element connected with the socket comprising electrical or electrical and data connections, has an external periphery configured to engage with an internal shape of the socket.

17. The coupling device according to claim 3, wherein the second ending of the socket connectable intermediate element connected with the socket comprising electrical or electrical and data connections, has an external periphery configured to engage with an internal shape of the socket.

18. The coupling device according to claim 2, wherein the integrated light source is a LED street lamp and the socket comprising electrical or electrical and data connections is located in the street lamp post.

19. The coupling device according to claim 7, wherein an internal shape of the cross-section of the second end of the light source connectable intermediate element is configured to engage with the external shape of the cross-section of the integrated LED street lamp.

20. The coupling device according to claim 11, wherein telescopic connections of the socket connectable intermediate element and the light source connectable intermediate element and the blocking mechanisms are provided with moisture and water tight gaskets.

* * * * *